United States Patent [19]

Cahn et al.

[11] Patent Number: 4,662,433

[45] Date of Patent: May 5, 1987

[54] INDIVIDUAL COMFORT CONTROL DEVICE

[76] Inventors: Robert P. Cahn, 799 Ridgewood Rd., Millburn, N.J. 07041; Norman N. Li, 620 Rolling La., Arlington Heights, Ill. 60004

[21] Appl. No.: 645,239

[22] Filed: Aug. 29, 1984

Related U.S. Application Data

[63] Continuation-in-part of Ser. No. 348,502, Feb. 11, 1982, abandoned.

[51] Int. Cl.[4] ..... F28F 7/00

[52] U.S. Cl. ..... 165/46; 237/1 R; 237/1 SL; 62/259.3; 128/400

[58] Field of Search ..... 165/46, 58, DIG. 20; 237/1 R, 1 SL; 128/400, 399; 62/259.3

[56] References Cited

U.S. PATENT DOCUMENTS

| | | | |
|---|---|---|---|
| 2,153,644 | 4/1939 | Schicrenbeck | 165/DIG. 20 |
| 3,869,871 | 3/1975 | Rybalko et al. | 165/46 |
| 4,132,262 | 1/1979 | Wibell | 165/46 |

*Primary Examiner*—Henry Bennett

[57] ABSTRACT

The instant invention is a major energy saver in the form of a blanket which allows personal heat control, particularly cooling. More specifically, the blanket is provided with internal ducts through which a stable foam is circulated as a cooling fluid in such a way that the inside of the blanket facing the person being cooled is maintained at a temperature slightly below body temperature, while the outside of the blanket is insulated to minimize heat exchange with the environment. Compared to the use of a liquid as the circulating cooling fluid, foam is very light and thus minimizes the weight of the blanket, but it has better heat transfer properties and heat capacity than a gas. Cooling of the recirculating cooling fluid is done separate from the blanket in a refrigeration unit connected to the blanket by a feed and return duct. The refrigeration unit can operate by means of a heat pump, or use a stored refrigerant such as ice, or employ a continuous coolant, such as tap water. The integrity of the circulating foam is maintained by passing a certain fraction of the circulating fluid through a foam regeneration unit which both reconstitutes foam which has started to collapse and agglomerate, and regenerates foam which has completely broken when the unit is out of service for extended periods.

24 Claims, 1 Drawing Figure

INDIVIDUAL COMFORT CONTROL DEVICE

This application is a continuation in part of pending application U.S. Ser. No. 348,502 filed Feb. 11, 1982 now abandoned.

BACKGROUND OF THE INVENTION

Residential heating and cooling are major energy consumers. Heating, which consumes foosil fuel such as gas or oil, or electrical energy, can be reduced by turning down the heat at night and using heavy bed covers or electric blankets to maintain personal comfort while sleeping. The energy requirements, even in the case of electrically heated blankets, have been sharply reduced, since, instead of heating the whole house or several rooms to the required high temperature, the heating duty can be restricted to that of a very small, well-insulated volume, namely the space occupied by the person sleeping, and confined by the mattress at the bottom and the blankets on top. Since the human body generates a certain amount of heat, the only energy input required by the electric blanket heating elements is to make up for the heat lost through the blankets and mattress, in order to maintain a comfortable bed temperature. Depending on the room temperature and the temperature required to achieve a satisfactory personal comfort level, the energy input requirements of the electric blanket may be very low or zero.

On the other hand, for cooling purposes during warm and humid evenings and nights, blankets are of no avail and, in order to achieve an adequate level of comfort when resting or sleeping, the whole house, or at least the bedroom area, has to be cooled by means of air-conditioning, a high energy consumer. The present invention provides a means to achieve a high degree of energy conservation by restricting the necessary cooling requirements only to the bed volume occupied by the person resting or sleeping. Again, this volume is well insulated, minimizing the amount of heat absorbed from the warm outside. The invention, therefore, as will be described, will enable the homeowner to turn down his room or central air conditioner at night to a very low level, or turn it off altogether, yet achieve a high degree of temperature comfort while sleeping under the cooling blanket.

The invention, as will be described, is not restricted to specifically a blanket, nor specifically to a blanket to provide sleeping comfort. The cooled cover can be form-fitted to resemble a garment, such as a jacket or robe, to provide cooling when sitting and working at a desk, watching television, working, or eating. The cooling blanket, as such, can of course be used to cover a sitting or lying person.

Further, the invention, as described, is not restricted to cooling, but can also be used for heating. However, it is distinct from an electric blanket or an electrically heated garment in that the heat supplied by means of a heat pump comes from a source which is separate from the blanket or garment, and is connected to it via a feed and return duct through which the foam heating fluid is circulated. The same device which provides cooling in the summer can supply heating in the winter by a simple reversal of the heat pump from cooling to heating service.

The use of foam to effect the personal cooling and heating achieved by means of the instant invention has a number of distinct advantages. Foam has a reasonable heat capacity, so that the amount of circulating fluid, in the form of said foam, can easily be handled through the required passages without excessive pressure drop and without making any sound. The quantity of circulation required compared to a gas is far less, and much more effective heat transfer is realized. However, the major advantage is that, compared to a liquid, foam is much lighter and will actually not add appreciably to the weight of the blanket. Since blanket or clothing weight is a major comfort consideration, this light-weight feature of circulating foam is an important consideration in the practicality of the overall concept.

BACKGROUND OF THE PRIOR ART

Heating blankets, especially those provided with electric resistance elements, are well known and widely used. Cooling blankets, such as disclosed in U.S. Pat. No. 4,132,262, are provided with ducts for cooling fluids, such as circulating water or brine. Devices of this kind are frequently used for medical purposes, such as for rapidly lowering the temperature of a patient prior to difficult surgery requiring a slow-down of the patient's metabolism and oxygen demand. However, such blankets do not have the features disclosed in the instant application, such as light weight, use of foam as a coolant, and careful temperature control to prevent moisture condensation. Similarly, hot or cold compresses are available as medical appliances which feature circulating a heating or cooling fluid through a flat device which can be wrapped around an arm, a leg, or part of the body which needs to be heated or cooled. Again, water is usually the circulating fluid, since weight and comfort are not critical features for such applications, and since the degree of heating or cooling required for these appliances is much higher than that needed for a device supplying comfort control only, to a person usually at rest.

Garments, such as gloves, socks or shoes, which can be heated by a portable electric battery, are also known. Obviously, the only heat which can be supplied is the heat equivalent of the electric power which can be drawn from the battery. In the present invention, use of a heat pump using this battery power as well as the heat generated by the internal resistance and other losses of the battery is able to provide a multiple of the heat delivered by the conventional resistance device. The use of foam as the heat transfer fluid decreases the weight and increases the comfort and portability of the device. Heated and cooled suits, such as disclosed in U.S. Pat. No. 3,869,871, are employed by special professions ranging from astronauts to workers in chemical and metallurgical plants, who have to enter furnaces or other enclosures which are too hot for comfort or safety. Such cooling may be provided by circulating water, brine or refrigerant, or by compressed air which is expanded through special devices (Ranque tube) to provide cooling. Foam is not used, and especially not a foam which is a refrigerant.

The use of stable foam as a circulating cooling fluid is a novel approach. In general, foam is considered an insulator which, on account of its many bubbles of entrapped gas, provides poor heat transfer through a space filled with it. Of course, this property is used extensively in the construction and appliance industries where rigid foam is a favorite insulating material. However, even ordinary gas-liquid foam can be used for insulating purposes, provided it is held in place and not allowed to circulate. For example, such an application is described in Ohio Agricultural Research and Development Administration, Summary of Conference, Mar. 20, 1977, p. 20–21, where a gas-liquid foam is used to fill the space between the polyethylene walls of an inflatable green house, and thus act as insulation during the winter months. Since the foam is stationary, it acts as an insulator exactly like rigid foam insulation in buildings and appliances.

Flowing foam, on the other hand, has reasonably good heat transfer properties, since flow of the fluid continually exposes new liquid to the heat transfer wall of the fluid conduit. When the foam is stationary, the many gas bubbles in it act as effective insulators, preventing heat transfer from the liquid in the foam not adjacent to the wall to the heat transfer walls. When the foam is in motion, however, fluid turbulence will bring this internal liquid to the wall and greatly enhance the heat transfer properties of flowing compared to quiescent foam. A good example of the use of such flowing foam for heat transfer is described in U.S. Pat. No. 2,153,644, where a freshly made turbulent foam is used as a cooling agent in an indirect heat exchanger. However, the foam employed is not stable, it is essentially a froth, and either breaks up into its constituent gas and liquid after a very short period, or is totally converted into the vapor phase by evaporation of the constituent liquid phase as a result of the transferred heat. In any case, the foam is continually prepared freshly from the cooling gas and liquid, and there is no mention of using this foam in a circulating manner, which includes both heating and cooling of the circulating foam.

DESCRIPTION OF THE DRAWING

In the accompanying drawing.

DESCRIPTION OF THE INVENTION

Figure 1:
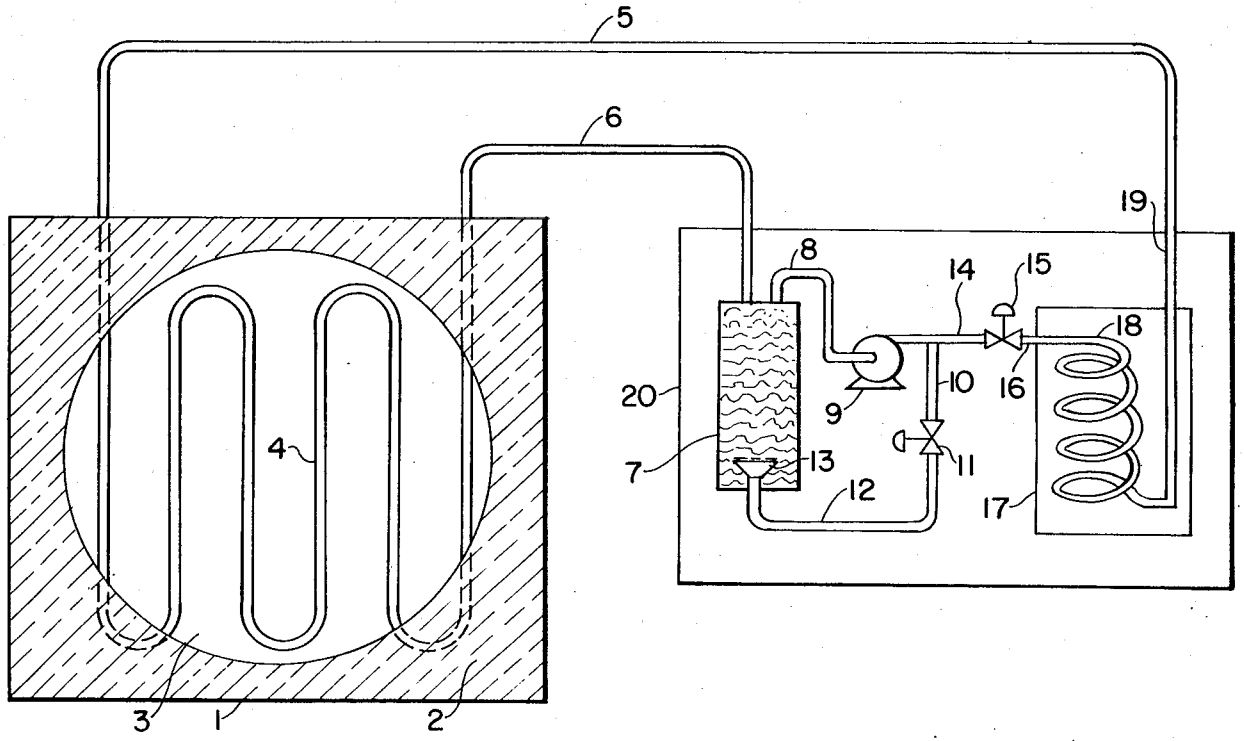
FIG. 1 shows a specific embodiment of the invention in the form of a cooling blanket.

In its most general form, the invention comprises a multilayer flexible instrument, such as a sheet, one layer of which contains passages for a heat transfer fluid, a heat exchanger-containing device in which the heat transfer fluid is adjusted to the desired temperature, pumping devices to circulate said heat transfer fluid, and ducts connecting said flexible sheet with said heat exchanger-containing device for the purpose of circulating said heat transfer fluid between the sheet and heat exchanger-containing device, the improvement which comprises the use of a stable foam as said heat transfer fluid. By stable foam is meant a foam which, in quiescent state, i.e. when not circulating, will not lose more than 10% of its volume per hour, preferably not more than 5% per hour, and most preferably not more than 2% per hour. The said flexible sheet may be in the form of a blanket or pillow, or a mattress, or other flexible, upholstered portion of a piece of furniture such as an easy chair, or a passenger seat in a plane or vehicle, or a form-fitted garment to be worn as a jacket, gloves, socks, robe or other piece of personal clothing. The heat-exchanger-containing device may heat or cool the circulating stable foam. It may operate by any known method of adding or removing heat from a fluid, such as an ice-box, refrigerating heat pump, heating heat pump, electric resistance heater, combustion-type heater, or exchange against a constantly replenished supply of exchange medium, such as hot or cold water from the house running water system. The circulating fluid may be a simple foam comprising principally air and water, but the gas phase of the foam may also comprise an inert gas like nitrogen, or a refrigerant. The foam may thus be a complex mixture of a vapor phase and several liquid phases. The liquid phase of the foam will also contain a surfactant to stabilize the circulating foam.

Foam is a particularly advantageous heat transfer medium for the present invention. When the composition of foam is expressed in volume ratios of liquid to gas, stable foams can be made of 1/1 to 1/30 or even more gas. In any case, it is obvious that the density of this foam is only a small fraction of the density of the liquid phase contained in this foam. Thus, if the liquid/gas ratio of the foam is 1/a, where "a" is equal to or greater than 1, then the density of the foam, neglecting the density of the vapor phase, is $1/(1+a)$ times the liquid density. When $a=20$, the foam density will be less than 5% of that of the liquid density. Now, for a device which has to be carried, such as clothing, or which lies on top of a person, like a blanket, weight is an important consideration. If the ducts or heat transfer channels in the device were filled with the liquid, excessive weight would cause discomfort, and this would have precisely the opposite effect of what the device was supposed to achieve. Use of foam eliminates the weight problem as it adds very little to the weight of the device, while it achieves the desired cooling and heating duty.

Foam has a reasonably good heat capacity, again determined by the ratio 1/a of liquid to gas. Again, neglecting the heat capacity of the vapor state, the heat capacity of the foam can easily be expressed as a function of 1/a and the heat capacity of the liquid phase. For personal comfort maintenance, foam circulation at a reasonable rate is sufficient. Foam also possesses adequate heat transfer properties while it is being circulated through the conduits in the blanket or similar device so as to allow heat to be absorbed or given up by the blanket, as desired.

A specific embodiment of the invention is a cooling blanket for use on a bed to maintain a comfortable temperature for the occupant or occupants of the bed while the ambient temperature is uncomfortably high. The blanket is made up of two layers. An insulating layer, which may be a textile such as wool, felt, or synthetic fabric, or a flexible plastic foam, and a layer comprising ducts through which the heat transfer fluid, the stable foam, is allowed to circulate. The walls of this duct layer may be made of thin rubber or similar flexible plastic or elastic material through which heat can pass into the heat transfer fluid from the space or person to be cooled. In the case of the bedcover blanket, the insulating layer faces up and minimizes environmental heat being picked up by the cool heat transfer foam, while the duct layer faces down, facilitating cooling of the bed space. Multiple ducts in the duct layer assure a good heat transfer surface for the desired cooling. The foam passes through the the duct layer and, having picked up the desired heat load, leaves the blanket via a conduit which connects the blanket to a cooling device. This cooling device may comprise a foam pump and a cooling coil through which the heated foam is passed and in which the foam is cooled to the desired level by means of heat exchange with another fluid, the refrigerant. This refrigerant may be ice or an ice water reservoir, circulating cool water, or cooled refrigerant being processed in a conventional refrigeration device well known in the art. The cooled foam is then returned to the cooling blanket via a conduit to complete the cycle.

The conduits connecting the blanket and cooling device should, of course, be well insulated to prevent heat pick-up from the environment. These conduits may be quite long in order to allow a central cooling device to service a number of cooling blankets and/or jackets. These conduits may also be provided with appropriate inlets and outlets to permit "plugging in" blankets using conventional plug and outlet devices. Thus, when a home is "wired" with appropriate cooled foam supply and used foam return conduits, cooling blankets and cooling jackets can be plugged in wherever needed, and the home refrigerator, or a window air-conditioner can be used as the central cooling device.

In its simplest embodiment, the foam will comprise water and air, with a small amount of surfactant, in the range of 0.001 to 1% by weight of the water. Many ionic and nonionic surfactants are well known in the art, such as sodium salts of aliphatic or alkyl-aromatic sulfonic acids, ethylene oxide oligomers, and many others which will stabilize air-in-water foams. Other substances, such as preservatives, bacteriocides, odorants, coloring agents, etc., can be added without detracting from the present invention. Other liquid materials, such as glycol or glycerine, and similar organic compounds can be included to improve foam stability, as can inorganic or organic salts such as phosphates or benzoates. Anti-corrosion agents may be incorporated such as chromates or borates, to minimize attack on any metallic surfaces with which the foam may come in contact. They could also minimize any degradation of the foam with time due to oxidation or other undesirable reaction.

While air is the preferred gas constituent, the original charge foam can be made up with an inert gas, such as nitrogen, carbon dioxide or a gaseous fluorocarbon, ar mixture of the same.

In order to simplify the cooling device, reduce the pumping requirements, allow smaller ducts and conduits to be used, it may be advantageous to use a compound foam which, besides water and a gas, will contain a refrigerant which will change phase under the temperature and pressure operating conditions of the foam in the cooling or heating blanket. Such a refrigerant may be a fluorocarbon or a fluorochlorocarbon which is in the liquid phase when the foam is cooled and leaves the cooling device, but evaporates during use as the foam picks up heat in the course of its cooling duty. As a result, the spent foam may consist of a liquid phase comprising mostly water, surfactants, etc., and a vapor phase comprising the evaporated refrigerant and any permanent gas constituent originally present. The cooled fresh foam, on the other hand, will have a portion of said refrigerant in the liquid phase which may be separate from and dispersed in the surfactant containing aqueous phase. The vapor phase of the cooled fresh foam will be a mixture of uncondensed refrigerant vapor and permanent gas constituent, if any, such as nitrogen, air, carbon dioxide, and the like.

The advantages of this compound foam are two-fold. Since the latent heat of the condensed refrigerant is utilized in the cooling duty of the circulating foam, and since this latent heat is usually large compared with the sensible heat of the foam constituents, the amount of foam which needs to be circulated is considerably less than that needed when only the sensible heat of the foam is utilized. The other advantage is that the foam itself can be used as refrigerant, so that the cooling device may be simplified. While the circulating foam can be cooled and partially condensed using conventional, indirect refrigeration similar to what is done with a simple foam, the possibility exists of simply compressing the foam itself and condensing it against the ambient, i.e. the air or cooling water. This obviates the need for an intermediate refrigerant cycle.

Typical refrigerants which can be incorporated into compound foams are fluorocarbons and fluorochlorocarbons, but other substances with the right vapor pressure properties can be used.

The ducts inside the cooling blanket must be arranged so that there is good heat transfer between the space being cooled and the foam flowing through the ducts. While simple, smooth-walled, hollow ducts may be used for this purpose, foams have a tendency to exhibit laminar flow behavior and, consequently, poor heat transfer properties. The laminar flow behavior will prevent the portion of the foam passing through the core of the duct to reach the wall and exchange heat with the wall and the outside. This can be overcome by providing wall roughness, tortuosity, spiral inserts, or other static mixing devices inside the ducts. These devices need not be provided over the whole length of the heat exchange tubes, but may be present at frequent intervals to assure good remixing of annular and core liquids.

The above mentioned static mixing devices serve an additional important function. On account of their mixing action, they will counteract the slow natural tendency of the circulating foam to break apart, and for the gas bubbles in the foam to coalesce. When a foam with large gas bubbles, that is a coarse foam, passes through a static mixer, a finer foam is produced which is also more stable to break-up than a coarse foam. Consequently, as the foam circulates, with intermittent stops as a result of temperature control action, the foam will assume an equilibrium consistency determined by the rate of coalescence of the foam and the rate of foam regeneration accomplished by the static mixing devices.

The invention described herein may comprise other devices such as control valves, flow valves, temperature regulators, foam reservoirs, foam circulating pump, foam regenerator, liquid and gas make-up and purge provisions, alarms, but these are obvious to anybody skilled in the art and would not add significantly to the basic invention.

Foam generation and regeneration is an important function which must be incorporated into the device of this invention. The reason for this is that during lengthy periods of idleness, for example between air-conditioning seasons, the foam inventory in the device will break up into the constituent gas and liquid phases, even when an extremely stable foam is employed. Even during periods of operation, there may be some foam coalescence or break-up. It is for these reasons that a foam regeneration device be incorporated which can be operated intermittently or continuously when the device is running. One embodiment, but by no means the only one, is to use the main foam reservoir and the main foam circulating pump in the following manner: The pump takes suction from the top of said reservoir, while the pump discharge can go in two ways, either simultaneously or alternatively, (1) into the main cooling fluid circulating loop, through the cooling device and through the blanket, and (2) via a static mixer or sparger back into the bottom of the main foam reservoir. If there was any substantial break-up of foam in the reservoir, as after a lengthy period of idleness, the pump with its suction at the top of the reservoir will pick up any settled out gas phase, or foam enriched in gas phase, and inject this stream via the sparger, porous frit, or other bubbling device into the bottom of the main foam reservoir, filled with settled out liquid phase. If there had been any phase separation, this bubbling action will reconstitute the foam which will become finer as it begins to recirculate through the sparger and static mixer.

The invention will now be described in detail with reference to the accompanying drawing, FIG. 1, which shows a specific embodiment of the invention in the form of a cooling blanket.

The flexible instrument, in this example a cooling blanket 1, is shown here with the top insulating layer 2 partly stripped away to expose the duct layer 3 through which the cooling foam is allowed to circulate via ducts 4. Cooled foam flows into the blanket via conduit 5, and warmed foam, having picked up heat from the space to be cooled by the blanket, leaves the blanket via conduit 6. Conduit 6 takes the foam to the cooling device 20, where the entering foam is discharged into foam reservoir 7. Foam pump 9 takes suction from the top of reservoir 7 via line 8. The discharge from pump 9 is split into lines 10 and 14. Line 10, via control valve 11, recycles fluid through line 12 and sparger 13 back into the foam reservoir 7, while line 14, via control valve 15, delivers foam through line 16 into the cooling coil 18 immersed in refrigerant drum 17. The cooled foam leaves the refrigerant drum via line 19 and is returned to the cooling blanket 1 via conduit 5.

From the above description it is evident that the foam recirculates continuously through the loop formed by ducts 4, conduit 6, reservoir 7, suction line 8, pump 9, discharge lines 14 and 16, cooling coil 18, discharge line 19 and return conduit 5. The circuit formed by pump 9, discharge 10 and line 12 with sparger 13 into reservoir 7 and suction line 8 is merely a specific embodiment of a foam generation and regeneration means.

FIG. 1 thus shows that the foam acts as a heat carrier between cooling blanket 1 and cooling device 20, and as a heat transfer medium in the ducts 4 of the cooling blanket and in coils 18 inside the refrigerant drum 17.

The precise arrangement and timing sequence of foam recirculation, static mixers and spargers, and directing the pump discharge to the recycle sparger in the reservoir or to the recirculation loop through the foam cooler and the blanket are not critical to this invention and can be optimized by anybody skilled in the art. Suffice it to say that by proper arrangement of foam reservoir, fluid pumps, gas sparger and static mixers, and control means on the discharge of the fluid circulating pump, a sufficient inventory of suitable and stable foam for proper operation of the device can be assured.

During continuous operation, in order to prevent foam degradation and break-up, it is necessary that about 1–50% of the circulating foam pass through the foam regenerator. Thus, if 50 liters/hr of foam are circulated through the foam cooling coils and through the cooling blanket, 0.5–25 l/hr should be passed through the sparger for the purpose of maintaining foam integrity. The regeneration stream can be circulated at the same time or alternatively to the main foam circulation. Thus, the regeneration stream can be continuous or intermittent. During initial operation, in order to build up a sufficient foam inventory, all the foam can be circulated through the foam generator. While a foam regeneration rate of 1–50% of the circulation covers the broad range, a preferred range is 2–25%, and a most preferred range is 2–10%.

While a small portion of the foam, most preferably 2–10%, is being regenerated or emulsified into finer consistency, the bulk of the foam recirculates as such around the loop, passing as a foam both through a heating and a cooling zone. This use of a foam as a circulating heat transfer fluid in the present invention, specifically the use of a stable foam for this purpose, is in marked contrast to the prior art, where the only use of foam as a heat transfer fluid involves the continuous generation of all the foam from fresh liquid and gas phases, and where the stability of the foam was so poor that it broke apart about five feet above its point of introduction into a large industrial shell-and-tube heat exchanger. In the prior art, only cooling is achieved by this froth, there is no intent or mention of both heating and cooling, and there is no provision for a stable foam system to allow continuous recirculation and reuse of the same foam.

In the examples set forth below, the advantages of the invention over prior art are clearly demonstrated. In Example I, the energy savings of the invention are illustrated by comparing the cooling requirements of the bed-blanket with the power requirements for a central air-conditioning system. In Example II, the effectiveness of a cooling blanket operating with circulating foam is illustrated, showing that a very reasonable flow velocity will achieve satisfactory comfort conditions. In Example III, the velocities of a circulating ordinary foam blanket are compared with those of a compound foam blanket. In Example IV, the weight of a foam-filled blanket is compared with that of a liquid-filled blanket, illustrating the advantages of foam.

EXAMPLE I. Energy Savings as a Result of the Present Invention

An average home of 1300 ft.$^2$ floor area in the Mid-Atlantic region requires a 4 kw drive on its central air conditioning unit. This unit will operate approximately 50% of the time on a hot, humid night. Considering the 8-hour period from 10 p.m. to 6 a.m., the central air conditioner will therefore consume power to the extent of Overnight power drawn$=0.5\times4\times8=16$ kwh. Now, if there are four people in the house, and if the occupants are provided with cooling blankets on their beds, the central air-conditioner can be shut off. Instead, each person will be individually cooled with a blanket which has to remove 85 w/person, maximum, during the night. While this is the maximum rate, the average rate of cooling required by the blanket is about one-half of that. In addition, the cooling unit which rejects the heat removed from the bed spaces works approximately with a coefficient of performance of 3 between the refrigeration temperature and the rejection temperature, assumed to be the inside temperature of the house. Therefore, the power required to cool the four blankets for eight hours overnight will be Overnight power drawn$=4\times0.5\times8\times\frac{1}{3}\times0.085=0.45$ kwh. This is less than 3% of the power drawn by the central air conditioner. Individual room air conditioners use less power than a central air conditioner, but the relative savings would still be very impressive, close to 90%.

The use of cooling blankets can therefore result in major power savings.

EXAMPLE II. Cooling Blanket with Circulating Foam

Consider a cooling blanket for a single bed sufficient to cool a 3 ft.×5 ft. surface. The total heat which must be removed is 85 w, or 290 Btu/hr. maximum, and there is an average 10° F. temperature differential to achieve this heat transfer from the bed space at 80°-90° F. and the cooling blanket at 60°-80° F. The cooling fluid is assumed to consist of 10/1 vol. air/vol water ratio foam, entering at 60° F. and leaving at 80° F. The system is essentially at atmospheric pressure.

Between 60° and 80° F., the specific heat of this foam is 5.68 Btu/°F./ft.$^3$, or 114 Btu/ft.$^3$ for the 60°-80° F. range. At maximum load, therefore, 290/114=2.55 ft.$^3$/hr. of foam need to be circulated. Assuming the ducts in the blanket are ¼ in. wide, and paralleled to provide a 3 in. wide channel, with appropriate baffling, the linear foam velocity would be 1.63 in./sec., a very reasonable flow velocity.

In order to transfer the required 290 Btu/hr. over the available 3×5=15 ft.$^2$ of heat transfer surface, with a delta T of 10° F., the overall heat transfer coefficient for the blanket need only be 290/(15×10)==2 Btu/hr/°F./ft.$^2$, which is a reasonable coefficient for this type of service.

EXAMPLE III. Comparing Compound Foam with Simple Foam

If the air/water foam in Example II is replaced with a compound foam which contains nitrogen in place of air, and comprises a refrigerant in addition to the aqueous phase, a somewhat higher heat capacity per volume foam can be achieved. The foam for this Example contains refrigerant Freon-113, a fluorochlorocarbon produced by E. I. duPont and having a vapor pressure of 4.37 psia at 60° F., and 6.9 psia at 80° F. A foam of the following composition is admitted to the blanket at atmospheric pressure and at 60° F.:

| Component | Volume, ft.$^3$ | Weight, lb |
|---|---|---|
| Nitrogen | 5 | 0.4 |
| F-113, vaporized | 2.115 | 1.0 |
| Total Vapor Phase | 7.115 | 1.4 |
| Water | 0.661 | 41.2 |
| F-113, Liquid Phase | 0.051 | 5.0 |
| Total Liquid Phase | 0.712 | 46.2 |

This foam has a density of 6.082 lb/ft.$^3$ at a vapor/liquid ratio of 10/1. Between 60° and 80° F., the specific heat of this foam is 5.93 Btu/ft.$^3$/°F. or 119 Btu/ft.$^3$ for a 20° F. temperature rise. The amount of foam circulated at full load would amount to 2.44 ft.$^3$/hr., reducing the initial linear flow velocity of the foam to 1.56 in./sec.

The principal advantage of the compound foam is that the spent (heated) foam leaving the blanket can be compressed, the resultant compressed foam can be cooled in any conventional manner against the ambient, condensing some of the F-113 out of the compressed vapor, and the resultant regenerated foam-emulsion can be recycled directly to the blanket to repeat the cycle. This obviates the need for an intermediate refrigerant cycle.

EXAMPLE IV. Relative Weight of a Foam-Filled Blanket

In the cooling blanket of Example II, the cooling coils contain a ¼ in. thick layer of cooling fluid over a 3 ft.×5 ft. area. If the actual ducts cover 75% of this surface, the total volume of coolant in the blanket is 0.234 ft.$^3$. When water or brine are used as circulating coolant, the weight of this fluid in the blanket amounts to 14–16 lb., which is excessive for comfort. On the other hand, if a 10/1 gas/liquid foam is used, with a density of 5.73 lb/ft.$^3$, the added weight is only 1.34 lb., a negligible burden when distributed over 15 ft.$^2$.

From the foregoing examples, it should be readily apparent that foams are excellent means to transfer heat in or out of a confined space by means of flexible, light sheets, blankets, form-fitted apparel or other instruments which may be worn by a person or which may be moved, such as furniture. As a matter of fact, stable circulating foams may be of interest in any application of heating or cooling where weight is of primary interest. These foams may be simple or complex, and the device may be used for heating or cooling of a confined space which can best be described as a limited personal comfort zone. Because such a zone is much smaller than the normal living space in a house, office, or other building, the heating and cooling needs are far lower than normal requirements. In addition, the smallness of said comfort zone, and the lightness made possible by the use of foam as the heat transfer fluid, allows this invention to be used in particular where portability is an important consideration.

While the present invention has been described and illustrated by reference to particularly preferred embodiments thereof, it will be appreciated by those of ordinary skill in the art that the same lends itself to variations not necessarily illustrated herein. For this reason, then, reference should be made solely to the appended claims for purposes of determining the true scope of the present invention.

Having thus described and illustrated the present invention, what is claimed is:

1. A device for personal heat control, containing means for heating and cooling, said device comprising (a) a flexible instrument insulated on one side and containing ducts for the passage therethrough of circulating heat transfer fluid which performs said heat control by heat exchange, (b) heat exchange means in which the temperature of said circulating heat transfer fluid is adjusted to the desired level, (c) pumping means to circulate said fluid, and (d) ducts to allow the transport of heat by means of said circulating heat transfer fluid between said flexible instrument and said heat exchanger means, the improvement comprising that said circulating heat transfer fluid carrying out both the heat exchange and the heat transport is a stable foam and said device includes means to regenerate collapsed foam.

2. A device according to claim 1 where said flexible instrument is in the form of a blanket.

3. A device according to claim 1 where said flexible instrument is in the form of a garment.

4. A device according to claim 1 where said flexible instrument constitutes an upholstered part of a piece of furniture.

5. A device according to claim 2 used for the purpose of cooling a small space occupied by a person.

6. A device according to claim 5 in which said stable foam comprises air, water and a surfactant.

7. A device according to claim 5 in which said stable foam comprises a gas, water, a surfactant, and a refrigerant.

8. A device according to claim 1 wherein said stable foam, in its quiescent state, will not shrink more than 10% of its volume per hour.

9. A device according to claim 1 wherein said stable foam, in its quiescent state, will not shrink more than 5% of its volume per hour.

10. A device according to claim 1 wherein said stable foam, in its quiescent state, will not shrink more than 2% of its volume per hour.

11. A device according to claim 1 wherein the rate of fluid circulation through said means to regenerate collapsed foam is 2–25% of the rate at which foam is circulating through said flexible instrument.

12. A device according to claim 1 wherein the rate of fluid circulation through said means to regenerate collapsed foam is 2–10% of the rate at which foam is circulating through said flexible instrument.

13. The device of claim 3 in which said stable foam comprises air, water and a surfactant.

14. The device of claim 4 in which said stable foam comprises air, water and a surfactant.

15. A cooling blanket for personal comfort control, said blanket having insulation only on one side and containing therein ducts through which stable foam flows to exchange heat with a limited personal comfort zone covered by the uninsulated side of said blanket, said blanket being connected to means for cooling, regenerating and circulating said stale foam, wherein said stable foam carries out both heat exchange between the blanket and the limited personal comfort zone and heat transport between the blanket and said means for cooling said stable foam.

16. A cooling blanket according to claim 15 wherein said stable foam comprises air, water and a surfactant.

17. A cooling blanket according to claim 15 wherein said stable foam, in its quiescent state, will not shrink more than 10% of its volume per hour.

18. The device of claim 1 wherein said ducts contain means for improving heat transfer between the circulating foam and the wall of the duct.

19. The device of claim 18 wherein said means comprises wall roughness.

20. The device of claim 18 wherein said means comprise static mixing devices.

21. The device of claim 18 wherein said means comprises tortuosity.

22. The device of claim 1 wherein during initial operation all the foam is circulated through said means to regenerate collapsed foam.

23. A device according to claim 1 wherein the rate of fluid circulating through said means of regenerating collapsed foam is 1% to 50% of the rate at which foam is circulating through said flexible instrument.

24. A cooling blanket according to claim 15 wherein the rate of fluid circulation through said means for regenerating said stable foam is 1% to 50% of the rate at which foam is circulating through said blanket.

* * * * *